US005169047A

United States Patent [19]

Endres et al.

[11] Patent Number: 5,169,047

[45] Date of Patent: Dec. 8, 1992

[54] COMPACT RIVET ATTACHMENT APPARATUS

[76] Inventors: Thomas E. Endres; William J. Osiadacz, both of 155 Lightner Blvd., Tipp City, Ohio 45371

[21] Appl. No.: 785,085

[22] Filed: Oct. 30, 1991

[51] Int. Cl.[5] ..... B21J 15/00

[52] U.S. Cl. ..... 227/27; 227/61; 227/69; 29/34 B

[58] Field of Search ..... 227/27, 61, 62, 69, 227/153; 29/34 B, 525.2, 243.53

[56] References Cited

U.S. PATENT DOCUMENTS

| | | | |
|---|---|---|---|
| 2,179,900 | 11/1939 | Sheane | 227/61 |
| 3,111,869 | 11/1963 | Goff et al. | 227/62 |
| 3,478,567 | 11/1968 | Galntia | 227/61 X |
| 3,534,896 | 8/1968 | Speller et al. . | |
| 4,171,083 | 10/1979 | Lippacher et al. | 227/69 |
| 4,578,846 | 4/1986 | Schott et al. | 29/34 B |
| 4,955,119 | 9/1990 | Bonomi et al. | 227/69 X |

*Primary Examiner*—Douglas D. Watts
*Assistant Examiner*—Rinaldi Rada
*Attorney, Agent, or Firm*—Jacox & Meckstroth

[57] ABSTRACT

A movable frame is supported by a counter balancing winch or a robot and carries a horizontally movable shuttle on which is mounted a motor driven drill spindle and a parallel spaced anvil both movable in a vertical direction by corresponding fluid cylinders. A clamping bushing is supported by the frame for receiving a drill bit carried by the drill spindle and then receiving a rivet carried by spring fingers on the anvil. A J-shaped or C-shaped slide member is supported by the frame for vertical movement and carries a ram which opposes the anvil when in the clamping bushing. A hydraulic cylinder is mounted on the frame and has a downwardly projecting piston rod connected to the slide member, and a clamping tool is supported adjacent the ram by a fluid cylinder within the slide member. After two or more parts are clamped between the clamping bushing and tool, a hole is drilled within the parts, a rivet is inserted into the hole by the anvil, and then the rivet is upset further by movement of the ram with the slide member. The ram and clamping tool are supported by the slide member below a reference plane define by the parts, and the other components are located above the reference plane.

17 Claims, 2 Drawing Sheets

COMPACT RIVET ATTACHMENT APPARATUS

BACKGROUND OF THE INVENTION

In the art of rivet attachment equipment or apparatus, for example, of the general type disclosed in U.S. Pat. Nos. 3,534,896 and No. 4,578,846 the latter having an inventor common to the present application, it is common to move the workpieces or parts to be riveted together to a stationery riveting machine. Usually the machine is capable of drilling a hole within one or both of the parts and then inserting a rivet into the hole, after which the rivet is upset or swaged between upper and lower anvils pressed together by a hydraulic cylinder. The apparatus disclosed in the above mentioned '846 Patent also applies a liquid sealant prior to the swaging operation if it is also desired to have a fluid-tight seal between the parts and around the rivet.

It is sometimes necessary to attach parts with rivets and wherein it is not convenient to transfer the parts to a rivet machine. For example, in the attachment of the aluminum skin of an aircraft to aluminum frame components, ti is not uncommon for the hole drilling and rivet inserting and swaging operations to be performed by separate hand carried portable tools which perform the separate operations. For such rivet installations, it has been found desirable to provide a relatively small and compact portable rivet attachment tool or device which also has relatively light mass so that it may be easily and quickly moved by an operator or on the end of a robot arm or manipulator. It has also been found desirable for such a portable rivet attachment tool to be constructed for partial insertion into a small opening with in a workpiece, such as an aircraft door assembly, for installing and attaching rivets in an area close to the opening. With many rivet installations, it is further desirable for the tool or apparatus to incorporate a drilling head which automatically drills a hole within one or more of the parts to be attached prior to automatically inserting and swaging or upsetting a rivet within the hole.

SUMMARY OF THE INVENTION

The present invention is directed to a portable rivet attachment tool or apparatus which provides all of the desirable features mentioned above and which is especially adapted to be conveniently and quickly moved for installing a series of rivets within stationary parts. The rivet attachment apparatus of the invention is also adapted to be inserted into a relatively small opening within a workpiece or stationary parts for installing a series of rivets close to the opening and also operates in any position or attitude so that the rivet attachment apparatus can be mounted on the end of an arm projecting from a robot or as part of a manipulator.

In accordance with a preferred embodiment of rivet attachment apparatus constructed in accordance wit the invention, the above features and advantages are generally provided by a cast metal frame on which is mounted a bracket for suspending the apparatus with a cable depending from a weight counter balancing winch. The frame carries a handle bar and supports a laterally or horizontally movable carriage or shuttle on which is mounted a vertically movable power driven drill spindle and a laterally spaced vertically movable anvil. The frame also supports an upper clamping member or bushing which first receives a drill bit carried by the drill spindle for drilling a hole within the parts and then receives a rivet carried by spring loaded fingers mounted on the anvil.

The frame also has downwardly projecting spaced tracks which support a vertically movable J-shaped or C-shaped slide member removably connected to a piston rod extending downwardly from a hydraulic cylinder also mounted on the frame. The frame tracks and slide member projects downwardly through a reference plane defined by the parts to be riveted and supports a lower anvil or ram which is vertically aligned with a rivet carried by the upper anvil. A lower clamping bushing or member receives the ram and is supported by a fluid cylinder formed within the lower portion of the slide member. After the rivet attachment tool or apparatus is located relative to the parts to be riveted together, the tool operates automatically by first clamping the parts by partial upward retraction of the slide member with the hydraulic cylinder, drilling a hole within the parts, inserting a rivet into the hole with the upper anvil, locking the upper anvil, and then upsetting the rivet by further upward movement of the ram with the slide member.

Other features and advantages of the invention will be apparent from the following description, the accompanying drawings and the appended claims.

DESCRIPTION OF THE PREFERRED EMBODIMENTS

Figure 1:
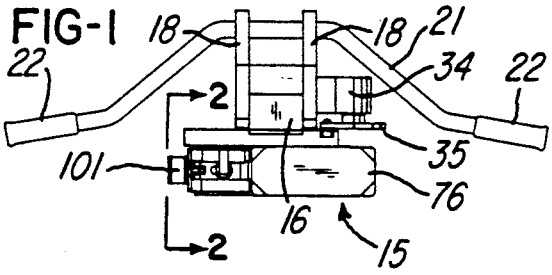
FIG. 1 is a plan view of a portable rivet attachment apparatus or tool constructed in accordance with the invention.

FIG. 1 shows a plan view of a rivet attachment apparatus or tool 15 which includes a cast metal frame 16 from which extends a pair of brackets 18 for supporting a handlebar 21 having opposite end portions with handle grips 22. An L-shaped bracket 24 is secured to the top of the frame 16 and has a hole 27 within its upper end portion for attaching a cable (not shown) which suspends the tool 15 from a winch which counter balances the weight of the tool 15 and permits it to be conveniently raised and lowered and maneuvered horizontally by gripping the handlebar 21. As mentioned above, the tool 15 may also be supported by the arm of a robot or similar computer controller manipular and operates in any attitude.

Figure 9:
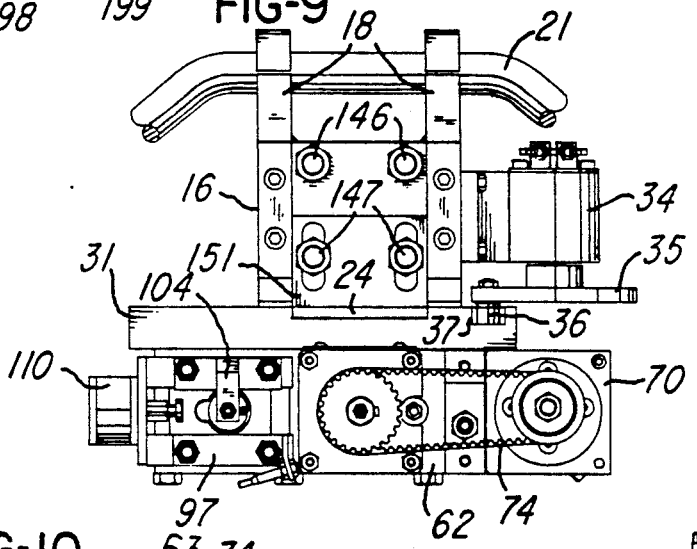
FIG. 9 is a plan view of the tool similar to FIG. 1 at a slightly larger scale and with a top protective cover removed.
Figure 10:
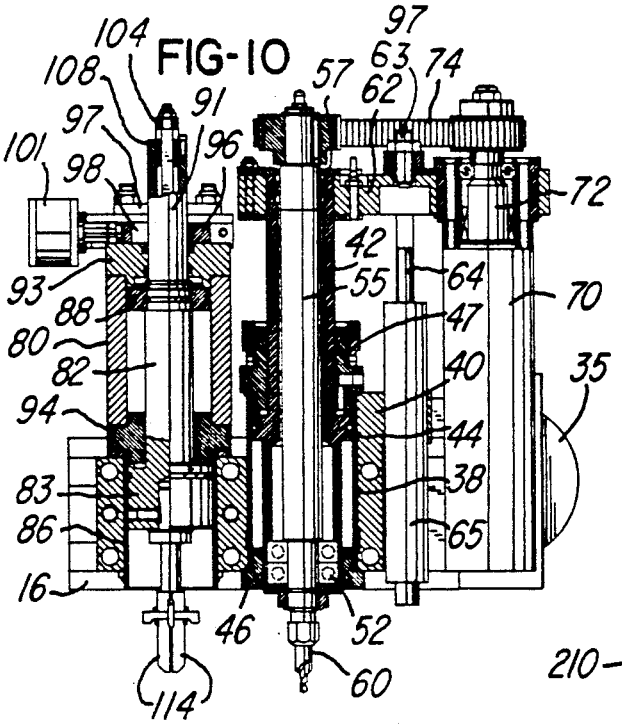
FIG. 10 is a fragmentary section taken generally on the line 10—10 of FIG 3.

A carriage or shuttle 30 (FIG. 3) is supported for lateral or horizontal movement by a set of tracks 31 and 32 secured to the frame 16, and a vertically adjustable rail 33 provides for obtaining precision sliding friction engagement with the shuttle 30. The shuttle 30 is shifted laterally by a servo motor 34 (FIG. 9) mounted on the frame 16 for rotating a disc 35 supporting n eccentric roller 36 within a cam slot 37 formed in the back surface of the shuttle 30. Referring to FIG. 10, a double acting fluid or air cylinder 38 is supported by a housing 40 secured to the front side of the shuttle 30 and encloses a quill 42 for vertical reciprocating movement by selectively introducing air on top of a piston 44 formed as part of the quill 42. A bushing 46 is secured to the lower end of the cylinder 38 and slidably supports the lower end portion of the quill 42, and an upper bushing 47 slidably supports the upper end portion of the quill 42. A pair of anti-friction bearings 52 are retained within the lower end portion of the quill 42 and rotably support the lower end portion of a drill spindle 55, and the upper end portion of the quill 42 retains a needle bearing 57 for rotably supporting the upper end portion of the spindle 55. A drill bit 60 is attached to the lower end portion of the spindle 55 as shown in FIG. 10.

A bracket 62 is mounted on the upper end portion of the quill 42 for vertical movement with the quill, and the center portion of the bracket 62 carries an adjustment stop screw 63. The stop screw engages the upper end portion of a piston rod 64 projecting upwardly form an adjustable hydraulic dash pot or shock absorber 65. The shock absorber 65 controls the feed rate of the quill 42 and spindle during drilling and is adjustably clamped to the housing 40 mounted on the shuttle 30. An adjustable speed brushless DC servo motor 70 has an upper end portion supported by on the bracket 42 and moves downwardly with the bracket 62 and quill 42 when air pressure is introduced into the cylinder 38 on top of the piston 44. The motor 70 has a shaft 72 which is connected to drive the spindle 55 through a gear belt drive 74 covered by a cover 76 (FIG. 1). The dash pot 65 provides a force upwardly on the piston rod 64 in order to control precisely the downward movement of the assembly of spindle 55, bracket 62, motor 70 and belt drive 74.

The housing 40, carried by the shuttle 30, also supports a double acting fluid or air cylinder 80 (FIGS. 3 and 10) which includes a vertically movable piston rod or arbor 82 having an enlarged lower end portion 83 slidably supported within a cylindrical liner sleeve 86. The arbor 82 carries a piston 88 and has a tubular upper end portion 91, and annular upper and lower end closures or caps 93 and 94 slidably support the piston rod 82 for vertical movement. As shown in FIG. 10, a laterally movable locking element or slide block 96 is slidably supported by the upper end cap 93 by a track member 97 and has a slot 98 for receiving the upper tubular end portion 91 of the piston rod 82. A fluid or air cylinder 101 is mounted on the track member 97 and has a piston rod connected to the slide block 96 for shifting the slide block laterally or horizontally.

Figure 3:
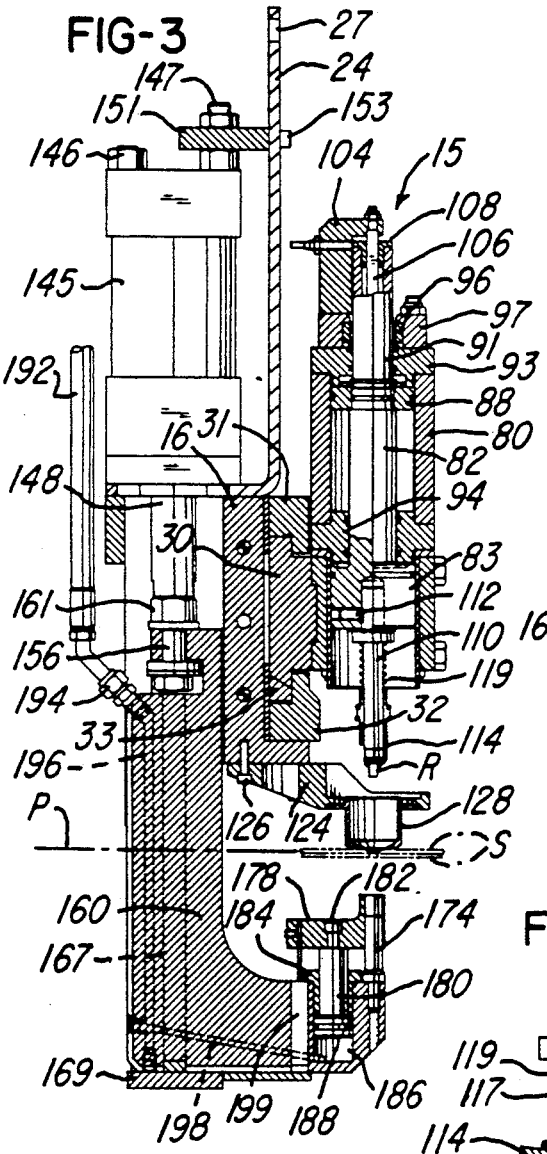
FIG. 3 is a slightly enlarged vertical section of the tool shown in FIG. 2.

Referring to FIG. 3, an inverted L-shaped arm 104 mounts on top of the track member 97, and the upper end portion of a square rod 106 is secured to the upper end of the bracket 104. The rod 106 extends downwardly through a mating square hole within a bushing 108 secured to the upper end portion 91 of the arbor 82 and prevents the arbor from rotating when it moves vertically within the cylinder 80. When the piston rod 82 is shifted from its normal retracted or upper position (FIGS. 3 and 10) to its lower position, the piston 88 engages the lower cap 94. The slide block 96 is then shifted laterally by the cylinder 101 until it blocks upward movement of the arbor 82.

Figure 6:
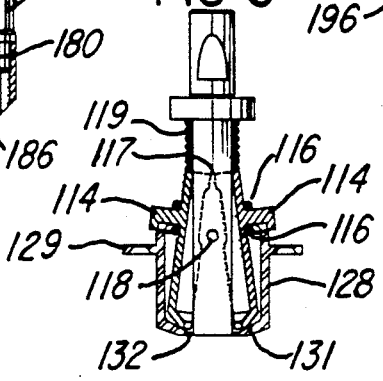
FIG. 6 is an enlarged vertical section of the upper clamping member or bushing after it receives the upper anvil and rivet support fingers.
Figure 7:
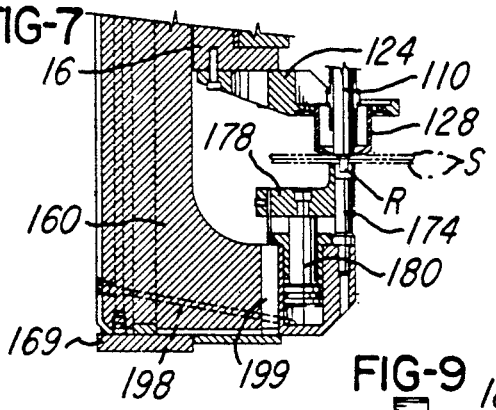
FIG. 7 is a fragmentary section of the lower portion of the tool shown on FIG. 3 and showing its position after a rivet has been inserted into a drilled hole within the parts.

Referring to FIGS. 3 and 6, an upper cylindrical ram or anvil 110 has an upper end portion removably retained with a set screw 112 within a bore formed in the lower end portion 83 of the arbor 82. The anvil 110 carries a pair of opposing pinch fingers 114 (FIG. 6) which are connected by pair of spring retaining rings 116 for holding the fingers 114 on the anvil 10 while permitting the fingers to pivot at 117 and move axially on the anvil 110 relative to a cross retaining pin 118 and against a compression spring 119. As shown in FIG. 3, the spring fingers 114 are normally urged downwardly on the anvil 110 against the cross pin 118 by the spring 119 and then are urged together by the springs 116 for gripping a rivet R having a flat head opposing the bottom end of the anvil 110. The rivets R are successively fed laterally between the fingers 114 by a conventional rivet feed mechanism (not shown) which feeds the rivets successively from a supply hopper.

Figure 2:
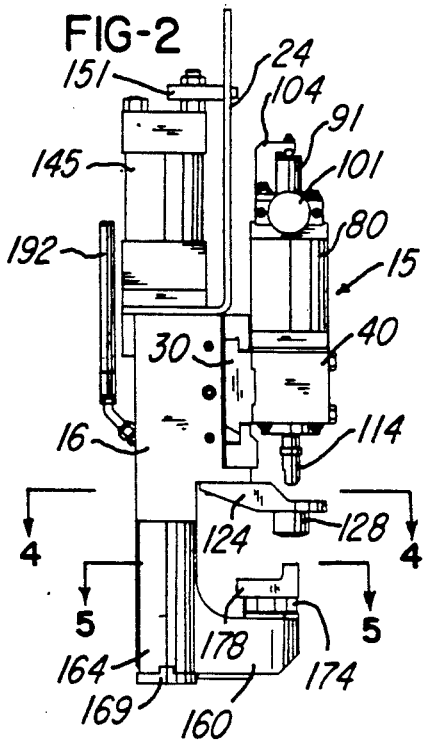
FIG. 2 is a side elevational view of the tool, taken generally on the line 2—2 of FIG. 1.
Figure 4:
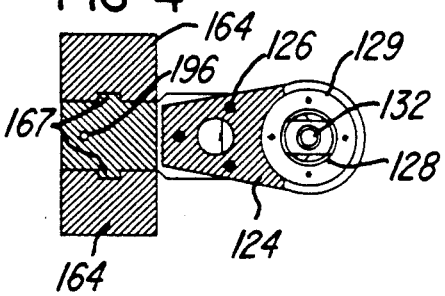
FIG. 4 is a horizontal section taken generally on the line 4—4 of FIG. 2.

As shown in FIGS. 2, 3 and 4, a cast metal arm or bracket 124 is secured to the frame 16 by a set of screws 126 and supports a cup-shaped upper clamping member or bushing 128 (FIG. 6) having a peripheral flange 129 removably attached to the arm 124 by a set of screws. As also shown in FIG. 6, the clamping bushing 128 has a tapered lower annular end wall 131 defining a circular opening 132 for receiving the lower end portion of the anvil 110. When the anvil 110 is lowered into the bushing 128 with a rivet being carried by the spring biased fingers 114, the fingers 114 engage the bushing 128 and release the rivet by tilting the fingers 114 outwardly and shifting the fingers upwardly on the anvil 110 against the pressure exerted by the spring 119. As shown in FIG. 3, the bottom surface of the clamping bushing 128 is adapted to engage a workpiece or parts to be attached together and represented by a pair of metal sheets S. The sheets S define a reference plane P which is normal to the axes of the spindle 55 and the arbor 82.

A fluid or hydraulic double acting cylinder 145 (FIG. 3) is secured to the frame 16 by a set of bolts 146 and 147, and has a piston rod 148 which projects downwardly with an axis parallel to the axes of the spindle 55 and the arbor 82. A plate 151 (FIG. 3) is attached to the bolts 147 and is secured to the support bracket 24 by a set of screws 153. A bolt 156 is threaded into the lower end portion of the piston rod 148 and is secured to the upper end portion of an L-shaped slide member 160 by a lock nut 161. The slide member 160 is supported for vertical sliding movement between a pair of guide rails 164 (FIG. 4) which project downwardly as part of the frame 16. The rails 164 have opposing grooves which receive corresponding ribs or keys 167 on the opposite sides of slide member 160 for guiding the slide member vertically in response to actuation of the cylinder 145. A connecting plate 169 is secured to the bottom ends of the rails 164 by a set of screws and also limits the downward movement of the slide 160 to its lower position, as shown in FIGS. 2 and 3.

Figure 5:
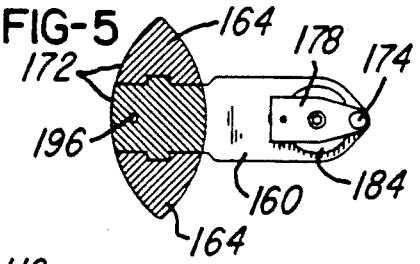
FIG. 5 is a section similar to FIG. 4 and taken generally on the line of 5—5 of FIG. 2.

Referring to FIGS. 2 and 5, the lower portions of the rails 164 and the lower portion of the slide 160 have mating curved outer surfaces 172 which corresponds to the diameter of the smallest hole within a workpiece for receiving the lower end portion of the tool 15. A cylindrical lower anvil or ram 174 (FIG. 3) is supported by the lower leg portion of the slide 160 in axial alignment with the upper clamping member or bushing 128 and the upper anvil 110 when it is aligned with the bushing 128. A lower clamping member or tool 178 has a bore which receives the ram 174 and is secured to the upper end of a piston rod 180 by a screw 182. The piston rod 180 is slidably supported by a bushing 184 inserted into a cylinder 186 which slidably receives a piston 188 on the lower end of the piston rod 180. Hydraulic fluid is supplied to the cylinder 186 from a flexible hose 192 extending from an air over oil tank, and a fitting 194 connects the hose 192 to a vertical passage 196 within the slide 160. The passage 196 connects with an inclined passage 198 which connects with the lower end of the cylinder 186. A variable displacement linear transducer 199 detects or senses the movement of the clamping member 178 and when the clamping member is exerting a predetermined clamping force.

In operation of the tool 15, the tool is maneuvered or manually positioned until the upper clamping bushing 128 is positioned directly over the spot on the workpiece or parts such as the sheets S where it is desired to install a rivet. The tool 15 then automatically operates by first actuating the cylinder 145 to retract the piston rod 148 and slide 160 upwardly until the lower clamping member 178 clamps the parts or sheets S against the upper clamping member or bushing 128. The fluid pressure within the cylinder 186 is adjusted according to the desired clamping pressure. The shuttle 30 is moved so that the rotating drill spindle 55 is axially aligned with the hole 132 within the clamping bushing 128. Air is introduced above the piston 44 on the quill 42 causing the rotating spindle 55 to move downwardly until the drill bit 60 passes through the hole 132 and drills a hole within the parts or sheets S.

Figure 8:
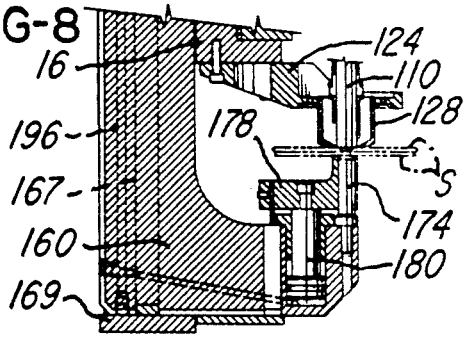
FIG. 8 is a fragmentary section similar to FIG. 7 and showing the position of the tool after a rivet has been upset or swaged.

After the air on the piston 44 reverses, the rotating quill 42 retracts upwardly to elevate the drill bit 60 from the bushing 128. The shuttle 30 then shifts laterally by actuation of the servo motor 35, and a rivet R is installed into the drilled hole within the sheets S by downward movement of the arbor 82 due to air pressure above the piston 88. The piston rod 148 is retracted into the cylinder 145 causing the slide 160 to move further upwardly until the lower anvil or ram 174 deforms or swages the lower end portion of the rivet R, as shown in FIG. 8. During the swaging operation, the arbor is locked by the block member 96. The cylinder 145 is actuated to extend the piston rod 148 and the slide 160 downwardly to their extended positions, as shown in FIGS. 2 and 3, for releasing the clamping of the parts. The tool 15 is then moved laterally relative to the parts or sheets S to the next location where it is desired to install another rivet. The force exerted by the lower anvil or ram 174 against the rivet R by the hydraulic cylinder 145 is substantially greater than the clamping force may be approximately 300 pounds while the ram force against the rivet R may be on the order of 8800 pounds.

Figure 11:
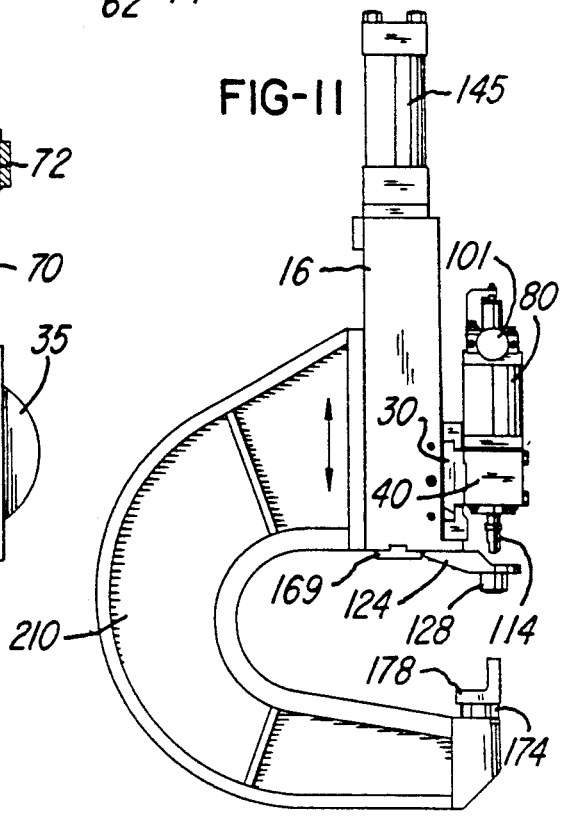
FIG. 11 is an elevational view of a rivet attachment tool or apparatus similar to FIG. 2 and constructed in accordance with a modification of the invention.

Referring to FIG. 11, when it is desired to install rivets adjacent an outside edge portion of a workpiece or parts, the slide member 160 of the tool 15 is removed by removing the bottom retaining plate 169 from the frame tracks 164 and releasing the bolt 156 from the piston rod 148. In place of the L-shaped slide member 160, a C-shaped side member 210 is installed by moving the slide member 210 upwardly into the grooves within the tracks 164, and then securing the retaining plate 169 to the bottom ends of the tracks 164. The slide member 210 is otherwise constructed the same as the slide member 160 and includes a lower anvil or ram 174 and the adjacent lower clamping member or tool 178. The remaining portion of the tool shown in FIG. 11 is constructed the same as the tool described above in connection with FIGS. 1–10, and the same reference numbers are used to identify the same components of the tool.

From the drawings and the above description, it is apparent that a rivet attachment tool or apparatus constructed in accordance with the present invention provides desirable features and advantages. As one primary feature, by constructing the tool in the manner shown in FIG. 3, the lower end portion of the tool, including the slide 160, the frame track portions 164, the ram 174 and the lower pressure member 178, is relatively small and may be inserted into a relatively small opening within a workpiece in order to install rivets adjacent the opening. In reference to FIG. 5, the diameter of the opening may be as small as the width of the lower portion of the slide member 160. Since the hydraulic cylinder 145 is above a reference plane p defined by the parts or sheets S to be attached and does not enter the opening within the workpiece, a hydraulic cylinder of substantial size may be used in order to swage relatively large rivets adjacent a small opening. In addition, if it is desired to provide the rivet attachment tool with a larger throat between the center line of the lower anvil or ram 174 and the inner surface of the slide 160, the slide 160 may be easily removed and replaced by a C-shaped slide such as the slide 210 having a substantially greater throat depth for receiving an outer edge portion of a workpiece.

As described above, the tool 15 automatically moves the slide 160 upwardly to clamp the workpiece or parts between the clamping members 128 and 178 and then drills a hole within the workpiece or parts, after the carriage or shuttle 30 shifts laterally, the tool 15 quickly installs a rivet within the drilled hole. A rivet R is then inserted into the drilled hole, and the air cylinder 101 is energized to move the slide block 96 into the path of the arbor 92. The upper anvil 110 is thereby locked in its lower position (FIGS. 6 and 7) for holding the rivet within the drilled hole. As soon as the arbor 82 is locked, the upward movement of the slide 160 causes the ram 174 to swage the lower end portion of the rivet, as shown in FIG. 8. Thus the tool 15 efficiently installs a series of rivets in a minimum time period.

While the forms of rivet attachment apparatus herein described constitute preferred embodiments of the invention, it is to be understood that the invention is not limited to these precise forms, and that changes may be made therein without departing form the scope and spirit of the invention as defined in the appended claims.

The invention having thus been described, the following is claimed:

1. A compact portable rivet attachment tool adapted to be supported for movement relative to two or more parts positioned to be connected together and defining a reference plane, said tool comprising a frame positioned on a first side of the reference plane, means mounted on said frame and supporting a first anvil member on said first side of the reference plane, a slide member supported by said frame for linear movement on the opposite second side of the reference plane in a direction perpendicular to the reference plane, a second anvil member supported by said slide member on said second side of the reference plane and in opposing relation to said first anvil member, a hydraulic cylinder mounted on said frame on said first side of the reference plane, movable means extending through the reference plane and connecting said cylinder to said side member for moving said slide member perpendicular to the reference to said frame, and said first anvil member cooperating with said second anvil member to upset a rivet extending between said anvil members through a hole within the parts in response to actuation of said hydraulic cylinder and movement of said slide member to said retracted position.

2. A tool as defined in claim 1 and including a first clamping member mounted on said frame on said first side of the reference plane and defining a hole for receiving a rivet, a second clamping member supported by said slide member adjacent said second anvil member on said second side of the reference plane, and means for moving said second clamping member relative to said slide member and toward said first clamping member to effect clamping of the parts together prior to upsetting the rivet between said anvil members.

3. A tool as defined in claim 2 wherein said means for moving said second clamping member comprise a fluid cylinder connected to said second clamping member, and said second clamping member clamps the parts adjacent said second anvil member.

4. A tool as defined in claim 3 and including means for detecting movement of said second clamping member relative to said slide member.

5. A tool as defined in claim 1 wherein said hydraulic cylinder includes a piston rod extending parallel to said first anvil member and said slide member.

6. A tool as defined in claim 1 wherein said frame includes track portions extending through the reference plane an supporting said slide member for said linear movement, and said track portions have a curved outer surface for extending said track portions and said slide member through a relatively small opening within at least one of the parts.

7. A tool as defined in claim 1 and including a bracket secured to said frame and providing for suspending said tool with a depending cable, and a handle grip bar secured to said frame to provide for manually moving said tool relative to the parts.

8. A tool as defined in claim 1 wherein said first anvil member comprises an elongated rod-like anvil, and power operated means supported by said frame for moving said anvil between a retracted position and an extended position, and means for locking said anvil in said extended position.

9. A compact portable rivet attachment tool adapted to be supported for movement relative to two or more parts positioned to be connected together and defining a reference plane, said tool comprising a frame positioned on a first side of the reference plane, a shuttle mounted on said frame for lateral movement on said first side of the reference plane and parallel tothe reference plane, a motor driven drill spindle supported by said shuttle, power operated means connected to said spindle for moving said spindle axially and perpendicular to the reference plane, means mounted on said shuttle and supporting a first anvil member for axial movement perpendicular to the reference plane, a slide member supported by said frame for linear movement o n the opposite second side of the reference plane and in a direction perpendicular to the reference plane, a second anvil member supported by said slide member on the second side of the reference plane and in opposing relation to said first anvil member, a hydraulic cylinder mounted on said frame on said first side of the reference plane and having a piston rod connected to move said slide member between an extended position and a retracted position relative to said frame, and said first anvil member cooperating with said second anvil member to upset a rivet extending between said anvil members through a hole drilled within the parts in response to actuation of said hydraulic cylinder and movement of said slide member to said retracted position.

10. Apparatus as defined in claim 9 and including a first clamping member mounted on said frame on said one side of the reference plane and defining a hole for receiving a rivet carried by said first anvil member, a second clamping member supported by said slide member adjacent said second anvil member on said opposite side of the reference plane, and means for moving said second clamping member relative to said slide member and toward said first clamping member to effect clamping of the parts together prior to upsetting the rivet between said anvil members.

11. Apparatus as defined in claim 10 wherein said means for moving said second clamping member comprises a fluid cylinder connected to said second clamping member, and said second clamping member clamps the parts adjacent said second anvil member.

12. Apparatus as defined in claim 9 wherein said frame includes spaced track portions extending through the reference plane and supporting said slide member therebetween for linear movement in said perpendicular direction and said track portions have a curved outer surface for extending said track portions and said slide member through a relatively small opening within at least one of the parts.

13. A compact rivet attachment tool adapted to be supported for movement relative to two or more parts positioned to be connected together at a reference plane, comprising a frame having means supporting a shuttle for linear movement on a first side of the reference plane and parallel to the reference plane, a power driven rotary drill spindle supporting a drill bit, means mounted on said shuttle and supporting said spindle for axial movement on said first side of the reference plane and in a second direction perpendicular to the reference plane for drilling a hole within the parts, an arbor spaced laterally from said spindle on said first side of the reference plane and supporting an anvil, means mounted on said shuttle for moving said arbor and said anvil parallel to the movement of said spindle and between retracted and extended positions, a first clamping member supported by said frame on said first side of the reference plane and positioned for selectively receiving said drill bit or said anvil, means for moving said shuttle laterally for positioning either said drill bit or said anvil adjacent said first clamping member, a slide member supported by said frame for linear movement on the opposite second side of the reference plane, a second clamping member supported by said slide member and cooperating with said first clamping member for clamping the parts between said first and second clamping members, a ram supported by said slide member adjacent said second clamping member and in opposing spaced relation with said anvil, and a hydraulic cylinder supported by said frame on said first side of the reference plane and having a piston rod connected to move said slide member and said ram between an extended position for receiving the parts between said clamping members and a rivet within the hole between said anvil and said ram and a retracted position for upsetting the rivet against the parts.

14. A tool as defined in claim 13 and including means for detecting movement of said second clamping member relative to said slide member and said ram.

15. A tool as defined in claim 13 wherein said frame includes parallel spaced track portions extending through the reference plane and supporting said slide member for said linear movement, and said track portions have a curved outer surface for extending said track portions and said slide member through a relatively small opening within at least one of the parts.

16. A tool as defined in claim 13 and including a bracket secured to said frame and providing for suspending said tool with a cable, and a handle grip bar secured to said frame to provide for manually moving said tool relative to the parts.

17. A tool as defined in claim 13 and including means for releasably locking said arbor and said anvil in said extended position during upsetting of the rivet. A tool as defined in claim

* * * * *

UNITED STATES PATENT AND TRADEMARK OFFICE

CERTIFICATE OF CORRECTION

PATENT NO. : 5,169,047

DATED : December 8, 1992

INVENTOR(S) : Thomas E. Endres and William J. Osiadacz

It is certified that error appears in the above-identified patent and that said Letters Patent is hereby corrected as shown below:

Column 1, line 24, delete "ti" and insert --it--.

Column 1, line 57, delete "wit" and insert --with--.

Column 3, line 4, delete "controller" and insert --controlled--.

Column 3, line 12, delete "n" and insert --an--.

Column 3, lines 34 delete "form" and insert --from--.

Column 5, line 62, after "force" insert --exerted by the lower clamping member 178. For example, the clamping force--.

Column 6, line 27, delete "p" and insert --P--.

IN THE CLAIMS

Column 7, line 9, delete "side" and insert --slide--.

Column 7, line 11, after "erence" insert --plane between an extended position and a retracted position relative--.

Column 7, line 40, delete "an" and insert --and--.

Column 7, line 62, delete "tothe" and insert --to the--.

UNITED STATES PATENT AND TRADEMARK OFFICE

CERTIFICATE OF CORRECTION

PATENT NO. : 5,169,047 Page 2 of 2

DATED : December 8, 1992

INVENTOR(S) : Thomas E. Endres and William J. Osiadacz

It is certified that error appears in the above-indentified patent and that said Letters Patent is hereby corrected as shown below:

Column 10, lines 12 and 13, delete "A tool as defined in claim".

Signed and Sealed this

Sixteenth Day of November, 1993

*Attest:*

Bruce Lehman

BRUCE LEHMAN

*Attesting Officer*

*Commissioner of Patents and Trademarks*